United States Patent [19]

Petts et al.

[11] Patent Number: 4,617,954

[45] Date of Patent: Oct. 21, 1986

[54] VALVE ASSEMBLIES

[75] Inventors: Nigel J. Petts, Chorley; John Marsh, Penwortham, both of England

[73] Assignee: Dobson Park Industries Plc., Nottingham, England

[21] Appl. No.: 589,488

[22] Filed: Mar. 13, 1984

[30] Foreign Application Priority Data

Mar. 26, 1983 [GB] United Kingdom ..... 8308382

[51] Int. Cl.[4] ..... F15B 13/042

[52] U.S. Cl. ..... 137/110; 91/29; 137/539

[58] Field of Search ..... 91/28, 29; 137/110, 137/114, 539, 539.5; 251/359, 360, 368

[56] References Cited

U.S. PATENT DOCUMENTS

| | | | |
|---|---|---|---|
| 1,428,998 | 9/1922 | Trace | 91/29 |
| 3,095,897 | 7/1963 | Pennstrom | 251/360 X |
| 3,365,167 | 1/1968 | Scaramucci | 251/368 X |
| 3,716,070 | 2/1973 | Klimkiewicz | 137/539.5 X |
| 3,776,098 | 12/1973 | Behrens | 91/29 |
| 4,391,181 | 7/1983 | Weirich | 91/29 |
| 4,485,724 | 12/1984 | Demircan | 91/29 |

FOREIGN PATENT DOCUMENTS

| | | | |
|---|---|---|---|
| 368413 | 3/1932 | United Kingdom | 137/539 |
| 790770 | 2/1958 | United Kingdom | 91/29 |

*Primary Examiner*—Robert G. Nilson

*Attorney, Agent, or Firm*—Murray and Whisenhunt

[57] ABSTRACT

A valve assembly is provided for use with a hydraulic mine roof support, the assembly having uni-directional control means 49 interconnecting first and second pressure sectors of the valve assembly, and further control means 20 embodied in the first pressure sector which further control means is arranged for activation by fluid pressure in the first pressure sector to allow pressure fluid to flow from the second pressure sector to the first pressure sector until the fluid in the first pressure sector is equal to or exceeds the fluid pressure in the second pressure sector.

14 Claims, 4 Drawing Figures

VALVE ASSEMBLIES

BACKGROUND OF THE INVENTION

The invention relates to valve assemblies and particularly to valve assemblies for use with hydraulic mine roof supports.

DESCRIPTION OF THE PRIOR ART

Hydraulic mine roof supports are well known and generally comprise a base unit and a roof engaging unit, interconnected by hydraulic jacks. In use the hydraulic jacks are used to set the roof engaging unit against a mine roof, to support the mine roof. The jacks are conventionally operated by a manually controlled valve gear. However there is a risk that the roof engaging unit of a hydraulic mine roof support may not be set into contact with a mine roof at a sufficiently high pressure to ensure safe support of the roof. For example if an operator closes the valve gear when the roof engaging unit appears visually to be in contact with the roof, there is nevertheless a risk that there is in fact still a slight gap between the roof engaging unit and the roof, not readily visible, or that the roof engaging unit, although touching the roof, is not actually urged against the roof under pressure to provide satisfactory support.

Attempts have been made to solve this problem by introducing, between the valve gear and the jacks, a valve assembly which permits hydraulic fluid to flow from the valve gear to the jacks, but also permits high pressure fluid to bypass the valve gear if the valve gear is closed prematurely. An example of this is shown in U.K. Pat. No. 2,042,035.

OBJECT OF THE INVENTION

The invention seeks to provide an improved form of valve assembly for use between the main valve gear and hydraulic jacks of a hydraulic mine roof support.

SUMMARY OF THE INVENTION

Accordingly the invention provides a valve assembly for use with a hydraulic mine roof support, comprising:

(a) a first pressure sector of the said valve assembly;
(b) a second pressure sector of the said valve assembly;
(c) uni-directional control means interconnecting the said first and second pressure sectors of the said valve assembly; and
(d) further control means embodied in the said first pressure sector, which further control means is arranged for activation by fluid pressure in the said first pressure sector to allow pressure fluid to flow from the second said pressure sector to the said first pressure sector until the fluid in the said first pressure sector is equal to or exceeds the fluid pressure in the said second pressure sector.

Preferably the further control means comprise a pressure sensitive valve.

Preferably the pressure sensitive valve is hydraulically unbalanced.

The pressure sensitive valve may comprise a valve spindle sliding sealingly in a bore, one end of the valve spindle being exposed to the pressure in the first pressure sector and an intermediate portion of the valve spindle comprising a valve member working in a valve chamber associated with the second pressure sector.

The other end of the valve spindle may be acted upon by a return spring.

The valve member of the valve spindle may co-operate with a valve seat manufactured from Delrin or like synthetic material. The synthetic material may have a metal support or reinforcement to reduce the risk of the synthetic material being deformed by pressure from the valve member.

Preferably the uni-direction control means comprises a non-return valve.

Preferably the valve member of the non-return valve comprises a spherical ball.

The ball may be trapped in a two-part valve cage, one part providing the valve seating.

The ball may be urged against the valve seating by a compression spring acting between the second part of the cage and the ball.

The non-return valve may be secured within a bore in the valve assembly by means of a plug.

An inlet to the second pressure sector may communicate with the periphery of the plug, and thereafter communicate with the non-return valve via at least one radially extending passage in the plug and at least one axially extending passage in the plug leading from the radially extending passage to the inner face of the plug.

There may be an annular chamber round the plug and a plurality of radial passages leading from the annular chamber to an axially extending passage.

The invention includes a valve assembly for use with a hydraulic mine roof support, the valve assembly comprising:

(a) a main supply passage;
(b) an outlet end of the said main supply passage, which outlet end will be connected in use to the said hydraulic mine roof support;
(c) an inlet end of the said main supply passage, which inlet end will be connected in use to a main control valve for supplying hydraulic fluid under pressure to the said hydraulic mine roof support;
(d) a bypass supply passage;
(e) an outlet end of the said bypass supply passage, which is connected to the said outlet end of the said main supply passage;
(f) an inlet end of the said bypass supply passage, which is connected in use to a source of hydraulic fluid under pressure;
(g) a non-return valve, contained in the said bypass supply passage;
(h) a pressure sensitive valve, contained in the said bypass supply passage, the said pressure sensitive valve being arranged to open on a predetermined pressure being sensed in the said main supply passage to permit hydraulic fluid under pressure to flow through the said bypass supply passage via the said pressure sensitive valve and the said non-return valve to the said outlet end of the said main supply passage;
(i) a valve seating; and
(j) a valve member which is at least part spherical and arranged to make line contact with the said valve seating, the said non-return valve comprising the said valve member.

The invention also includes a hydraulic mine roof support provided with a valve assembly comprising:

(a) a first pressure sector of the said valve assembly;
(b) a second pressure sector of the said valve assembly;

(c) uni-direction control means interconnecting the said first and second pressure sectors of the said valve assembly;

(d) further control means embodied in the said first pressure sector which further control means is arranged for activation by fluid pressure in the said first pressure sector to allow pressure fluid to flow from the said second pressure sector to the said first pressure sector until the fluid in the said first pressure sector is equal to or exceeds the fluid pressure in the said second pressure sector, this flow of fluid from the said second pressure sector to the said first pressure sector pemitting sluid to bypass a main control valve of the said hydraulic mine roof support to cause the said mine roof support to come into load bearing engagement with a mine roof in the event that the said main control valve of the said hydraulic mine roof support has been closed prematurely.

Other objects, preferred features and advantages will become apparent from the following description of an embodiment of the invention.

DESCRIPTION OF ONE EMBODIMENT OF THE INVENTION

Figure 1:
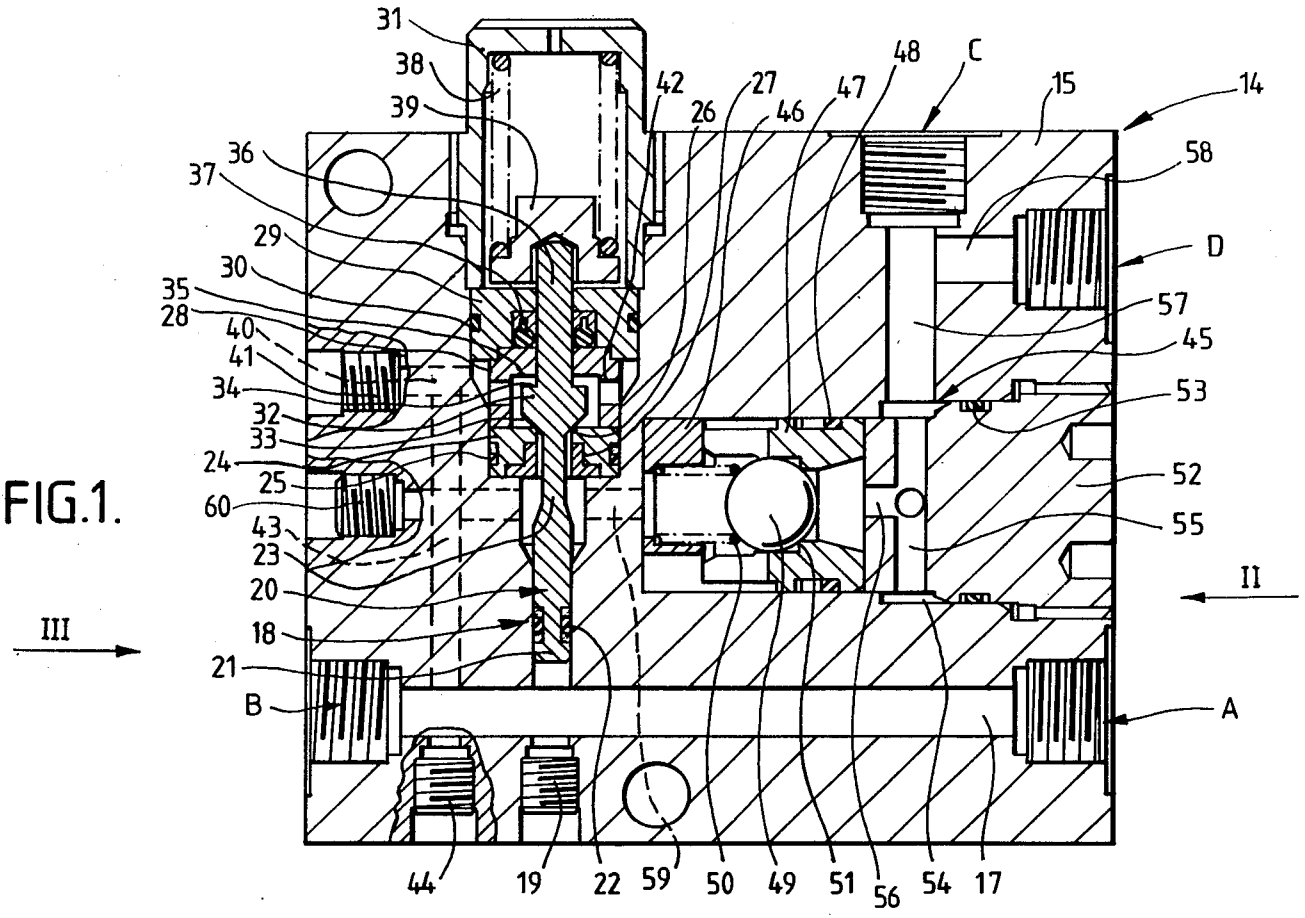
FIG. 1 is a cross-section through an embodiment of valve according to the invention.
Figure 2:
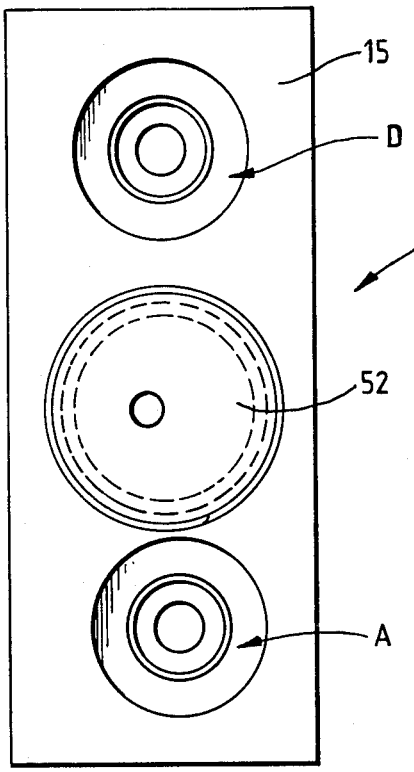
FIG. 2 is a view on arrow II of FIG. 1.
Figure 3:
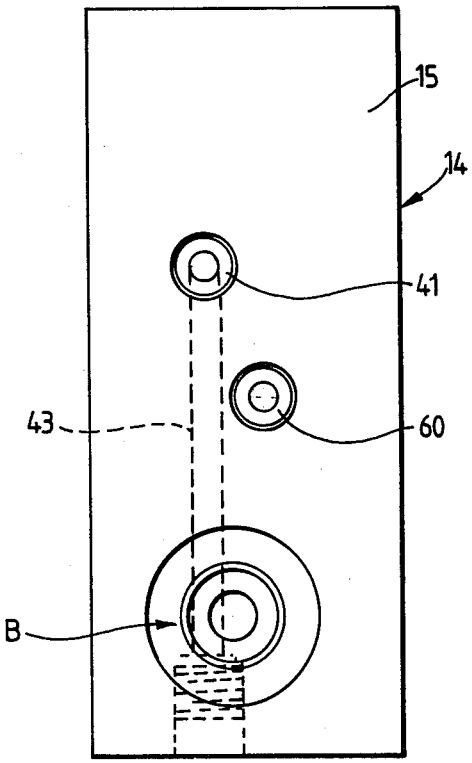
FIG. 3 is a view on arrow III of FIG. 1.
Figure 4:
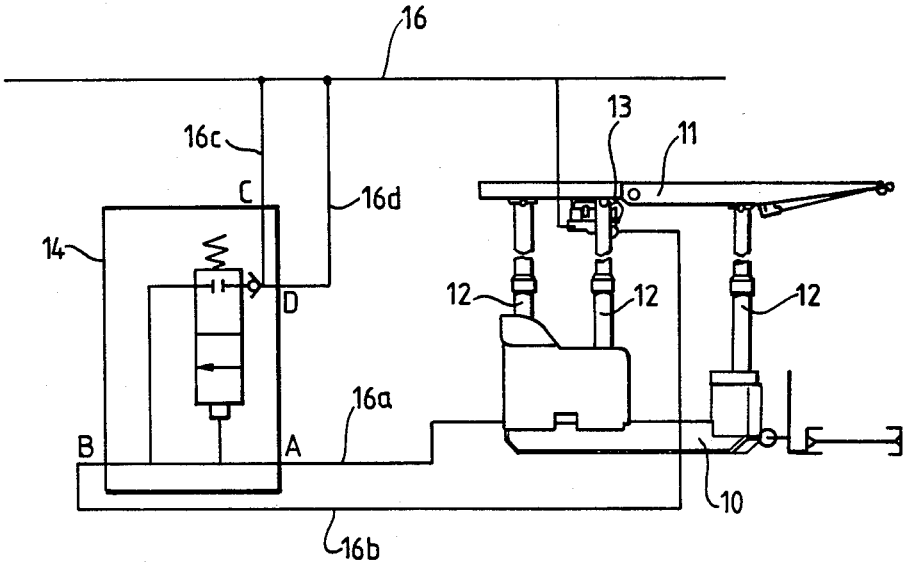
FIG. 4 is a diagrammatic view of the embodiment of valve in combination with a hydraulic mine roof support.

The valve forming the subject of this embodiment is intended for use with hydraulic mine roof supports such as that shown in FIG. 4, which comprises a base unit 10 and a roof engaging unit 11, interconnected by hydraulic jacks 12. In use the hydraulic jacks 12 are used to set the roof engaging unit 11 against a mine roof, to support the mine roof. The jacks 12 are operated by a manually controlled valve gear 13. If the valve gear 13 were directly coupled to the jacks 12, there is a risk that the roof engaging unit 11 might not be positively set into contact with the mine roof at a sufficiently high pressure to ensure safe support of the roof. For example if an operator closed the valve gear 13 when the roof engaging unit 11 appeared visually to be in contact with the roof, there would be a risk that there was in fact still a slight gap between the roof engaging unit and the roof, not readily visible, or that the roof engaging unit, although touching the roof, was not actually urged against the roof to provide any support. The valve which is shown in FIGS. 1 to 3 is intended to be interconnected between the valve gear 13 and the jacks 12, with a view to ensuring that the jacks 12 are positively set in position (i.e. are load bearing).

The valve is illustrated generally at 14 and comprises a generally rectangular valve body 15. The valve body has four active ports, which are marked A, B, C and D. Each port is tapped to receive the ends of hydraulic hoses 16*a* to 16*d* which are used to interconnect the apparatus as shown in FIG. 4.

The ports A and B are interconnected by a through drilling 17.

A stepped bore 18 intersects the drilling 17. The lower end of the bore 18 is closed by a plug 19.

A valve spindle 20 is positioned in the stepped bore 18. The spindle has a lower cylindrical portion 21 which slides within a lower portion of the stepped bore 18, an O-ring seal 22 being provided therebetween .The valve spindle 20 then has a narrow portion 23 which passes with clearance through an aperture in a valve seat 24. The valve seat 24 fits within yet another portion of the stepped bore 18, an O-ring seal 25 being provided therebetween. The valve seat 24 is made of Delrin and the active rim 26 of the seat is supported by an 'L' section steel reinforcement insert 27.

The valve seat 24 is held in position by a first sleeve 28. This in turn is held in position by a second sleeve 29 which fits within yet another portion of the stepped bore 18 and is sealed to the bore by means of an O-ring 30. A steel cap 31 is screwed into the outermost portion of the bore 18 to abut against the sleeve 29 and thus hold in position the sleeve 29, sleeve 30 and valve seat 24.

The narrow portion 23 of the valve spindle 20 then widens out into a valve portion 32 which has a mitred valve face 33 for engagement with the valve seats 24. As shown in FIG. 1, the valve portion is in engagement with the valve seat. Movement of the valve spindle away from the valve seat is limited by a shoulder 34 on the valve spindle arranged to abut a flange 35 on the sleeve 28.

The upper most portion 36 of the valve spindle 20 slides within the sleeve 29 and a conventional sealing member 37 is provided between the valve portion 36 and the sleeve 29.

The valve spindle is normally maintained in the closed position as shown by a compression spring 38 which acts between the underside of the cap 31 and a top-hat member 39 which fits over the upper portion 36 of the valve spindle 20.

A horizontal drilling 40, its outer end being closed by a plug 41, communicates with the portion of stepped bore 18 surrounding the valve member 32, via apertures 42 in the sleeve 35. A vertical drilling 43 interconnects drilling 40 and drilling 17, the lower end of drilling 43 being closed by a plug 44.

Turning now to the right-hand portion of FIG. 1, there is a further stepped bore 45 which projects horizontally into the valve block. Fitted into the narrowest portion of this stepped bore 45 is a valve housing formed in two parts, 46 and 47. An O-ring seal 48 surrounds portion 47. Trapped between these portions is a ball 49 which is urged by a compression spring 50 on to a valve seat 51.

The bore 45 is closed by a plug 52 which is screwed into the outermost portion of the bore 45 An O-ring seal 53 provides a seal between the plug 52 and bore 45.

Surrounding the plug 52 is an annular chamber 54 and the plug 52 has four interconnecting radial passages 55 which lead from this annular chamber to the centre of the plug. From the centre of the plug an axially extending bore 56 interconnects these radial passages 55 with the left-hand face of the plug.

The annular chamber 54 is connected to port C by a drilling 57. A further drilling 58 interconnects drilling 57 and port D.

It will be seen that the ball 49 acts as a non-return valve, and the left-hand end of the non-return valve is viewed in FIG. 1 is interconnected with the stepped bore 18, below the valve seat 24, by drilling through the valve block at 59. The left-hand end of the drilling 59 is closed by a plug 60 and to ensure that the drilling 59 does not intercept with the drilling 43, drilling 59 is offset to the right of the valve block, as can be seen from FIG. 3, and the drilling 43 is offset to the left.

In use port A is connected to the jacks 12 as shown in FIG. 4 by hydraulic hose 16*a*. Port B is connected to the valve assembly 13 by hose 16*b*. Either port C or port D is interconnected by hose 16*c* or 16*d* to a hydraulic fluid line 16 which contains hydraulic fluid at a pressure equal to the pressure which it is desired to produce in the jacks 12 to provide positive setting to the mine roof. The valve 14 may be physically mounted on the roof support and the hose 16*c* or 16*d* be connected to whichever port, C or D, can be most conventiently reached. The unused port is closed by a plug (not shown).

In use the valve according to this embodiment operates as follows:

When it is desired to set the mine roof support to a mine roof, the operator actuates the valve gear 13 which causes hydraulic fluid under pressure to flow from the supply line 16 to the hydraulic jacks 12 via the drilling 17. In other words the fluid flows from the valve gear 13 to the port B, passes through the drilling 17 to the port A, and passes from the port A to the jacks 12. The jacks 12 thus begin to extend, moving the roof engaging unit 11 towards the mine roof. If the operator holds the valve gear 13 open until the roof engaging unit 11 has engaged with the roof and has been urged against the roof under pressure by continued admission of hydraulic fluid to the jacks 12, then the bypass facility of the valve 14 is not required. If however the operator closes the valve gear 13 too soon, then the bypass facility provides an alternative route by which hydraulic fluid under pressure may continue to feed into the jacks 12 to bring about the necessary setting of the roof engaging unit 12 against the mine roof.

In case it is required, the bypass route is opened as soon as hydraulic fluid under pressure begins to flow through the drilling 17. This is because the lower end of the valve spindle 20 is exposed to the pressure in the drilling 17. This pressure causes the valve spindle 20 to move upwardly, against the action of the compression spring 38, lifting the valve member 32 off the valve seat 26. This enables high pressure hydraulic fluid to pass from port C or D through the non-return valve, through the drilling 59, through the pressure sensitive valve which has now been opened, and thence to the drilling 17 via drillings 40 and 43. Thus even if high pressure fluid ceases to reach port B from the valve gear 13, any necessary high pressure fluid continues to flow to port A through the valve from port C or port D.

The valve gear 13, and port C or port D, may be connected to the same source of high pressure fluid as shown or to separate sources as desired. The separate sources may be at differing pressures.

Once the valve has been opened, it will remain open until the legs are fully set.

Ideally line contact should be provided between the valve member 32 and the valve seat 26. However Delrin has a tendency to flow under pressure. To reduce the likelihood that the Delrin will flow thus deforming the valve seat 26 to give face contact rather than line contact, the metal reinforcement insert 27 is used. Face contact is undesirable since particles of dirt may get trapped between the opposing faces thus causing the valve to leak when in the closed position.

It is particularly important that the non-return valve should not leak in the closed position. The purpose of the non-return valve is to maintain pressure in the hydraulic jacks regardless of what happens downstream of the valve 14. If the valve 14 were to leak, then hydraulic fluid could gradually drain away from the hydraulic jacks thus reducing the efficiency of the hydraulic roof support. The non-return valve is therefore positioned downstream of the pressure sensitive valve and comprises a spherical ball engaging with the seating which is shaped to ensure line contact with the ball.

The invention is not restricted to the details of the foregoing embodiment. For instance port B may be blanked off, a T-piece or other device being connected to port A so that the through passage extends through the T-piece and the bypass passage extends through the non-return valve from port C or port D, through the pressure sensitive valve, through drillings 43 and 17 and then through the T-piece.

We claim:

1. A valve assembly for use with a hydraulic mine roof support, said valve assembly comprising a generally rectangular valve body, said valve body including:

first and second side faces, and first and second ends;

a main supply passage extending through said valve body in a straight line from said first end of said valve body to said second end of said valve body, parallel to said first and second side faces;

an outlet end of said main supply passage, said outlet end being connected in use to a hydraulic mine roof support.

an inlet end of said main supply passage, said inlet end being connected in use to a main control valve for supplying hydraulic fluid under pressure to said hydraulic mine roof support;

a bypass supply passage having an inlet portion extending parallel to said main supply passage, said inlet portion being connected in use to a source of hydraulic fluid under pressure, and an outlet portion extending at right angles to said inlet portion, connecting said inlet portion to said main supply passage intermediate the ends thereof;

a non-return valve contained in said inlet portion of said bypass supply passage;

a bore extending from said first side face of said valve body, parallel to said outlet portion of said bypass supply passage, intersecting said inlet portion of said bypass supply passage and communicating with said main supply passage;

pressure sensitive valve means mounted in said bore and defining a valve chamber positioned where said bore intersects said inlet portion of said bypass supply passage;

a pressure sensitive valve member working in said valve chamber having a face exposed to the pressure in said main supply passage, so that when the pressure in the main supply passage rises above a pre-determined limit, the pressure acting on said face moves said valve member in said valve chamber, connecting said inlet portion of said bypass supply passage to said outlet portion of said supply passage, to permit hydraulic fluid under pressure to flow through said pressure sensitive valve means to said main supply passage.

2. A valve assembly as claimed in claim 1, in which said pressure sensitive valve member comprises a valve spindle sealingly slidable in said bore, said valve spindle having an end which is exposed to the pressure in said main supply passage.

3. A valve assembly as claimed in claim 2, in which the other end of said valve spindle is acted upon by a return spring.

4. A valve assembly as claimed in claim 1, in which said non-return valve comprises a spherical ball.

5. A valve assembly as claimed in claim 4, in which said ball is trapped in a valve cage having first and second parts, said first part providing a valve seating.

6. A valve assembly as claimed in claim 5, in which said ball is urged against said valve seating by a compression spring acting between said second part of said cage and said ball.

7. A valve assembly as claimed in claim 1, in which said non-return valve is secured within said inlet portion of said bypass supply passage by means of a plug.

8. A valve assembly as claimed in claim 7, in which an access passage communicates from said second end to said bypass supply passage, said ball and cage being positionable in said bypass supply passage through said access passage, said plug being sealingly receivable in said access passage.

9. A valve assembly as claimed in claim 7, in which an inlet communicates with the periphery of said plug, and thereafter communicates with said non-return valve via at least one radially extending passage in said plug and at least one axially extending passage in said plug leading from said radially extending passage to an inner face of said plug.

10. A valve assembly as claimed in claim 9, in which an annular chamber is provided around said plug, and a plurality of radial passages lead from said annular chamber to an axially extending passage.

11. A valve assembly as claimed in claim 1, wherein said bore in cross-section is composed of a series of stepped portions of decreasing width and extending in a direction at right angles between said first and second side faces, said pressure sensitive valve member being insertable into said bore along said direction.

12. A valve assembly as claimed in claim 1, wherein said bore extending from said first side face is in communication in a straight line with an access bore extending from said second side face at right angles to said main supply passage, said access bore containing a plug during use of the valve assembly.

13. A valve assembly as claimed in claim 1, wherein said inlet portion of said bypass supply passage includes first and second inlet ports connected to said inlet portion and being connectable to a source of hydraulic fluid under pressure, said first inlet port extending from said first side face parallel to said outlet portion of said bypass supply passage, and said second inlet port extending from said second end at right angles to said first inlet port and being in communication with said first inlet port.

14. A hydraulic mine roof support fitted with a valve assembly as claimed in claim 1.

* * * * *